US010618720B1

(12) United States Patent
Schneider

(10) Patent No.: US 10,618,720 B1
(45) Date of Patent: Apr. 14, 2020

(54) SHOE CONTAINER STOOL WITH DEPLOYABLE FOOTREST

(71) Applicant: Todd Anthony Schneider, Jurupa Valley, CA (US)

(72) Inventor: Todd Anthony Schneider, Jurupa Valley, CA (US)

( * ) Notice: Subject to any disclaimer, the term of this patent is extended or adjusted under 35 U.S.C. 154(b) by 0 days.

(21) Appl. No.: 16/213,085

(22) Filed: Dec. 7, 2018

(51) Int. Cl.

| | |
|---|---|
| ***A47L 23/16*** | (2006.01) |
| ***A47G 25/84*** | (2006.01) |
| ***A47C 16/02*** | (2006.01) |
| ***B65D 81/36*** | (2006.01) |
| ***B65D 85/18*** | (2006.01) |

(52) U.S. Cl.
CPC ..... *B65D 81/36* (2013.01); *A47C 16/02* (2013.01); *A47G 25/84* (2013.01); *B65D 85/187* (2013.01); *A47L 23/16* (2013.01)

(58) Field of Classification Search
CPC ..... A47C 16/00; A47C 16/02; A47C 16/025; A47G 25/84; A47L 23/16; B65D 81/36; B65D 85/187
USPC ..... 297/188.01, 188.08, 423.1, 423.14, 297/423.39, 423.41, 462; 15/265
See application file for complete search history.

(56) References Cited

U.S. PATENT DOCUMENTS 52,977 A * 3/1866 Dodge ..... A47L 23/16 15/265
74,705 A * 2/1868 Macferran ..... A47L 23/16 15/265
155,524 A 9/1874 Lambert
634,379 A * 10/1899 Tobey ..... A47B 21/02 312/313
1,614,096 A * 1/1927 Aste ..... A47L 23/16 15/265
1,946,395 A * 2/1934 Fagelson ..... A47L 23/02 346/25
2,446,601 A * 8/1948 Lelyveld ..... A47L 23/16 312/117
D151,188 S * 9/1948 Price et al. ..... D6/350
2,607,946 A * 8/1952 Price ..... A47C 7/506 15/265
2,627,622 A * 2/1953 Kahl ..... A47L 23/16 15/265

(Continued)

FOREIGN PATENT DOCUMENTS

DE 102004009221 A1 9/2005
GB 190724616 A * 11/1908
GB 619614 A * 3/1949 ..... A47C 16/02

*Primary Examiner* — Ryan D Kwiecinski
(74) *Attorney, Agent, or Firm* — Williams Intellectual Property; Timothy Snyder

(57) ABSTRACT

A shoe container stool with a deployable footrest is described herein. The shoe container is in the form of a box having a front wall, a back wall, two side walls, and a top lid. The front wall includes a vertical elongated opening bounded by two side edges and a bottom edge. An elongated board is pivotally connected to the opening by way of an axle to permit the board to be pivoted into and out of the opening. A top portion of the board above the axle may therefore be deployed from the opening to be used as a footrest to help don and doff one's shoes, while the top lid may be used as a seat. The shoe container further includes a shelf inside the box to counter the forces applied to the footrest and also permits a user to store one's shoe inside the shoe container.

14 Claims, 3 Drawing Sheets

(56) References Cited

U.S. PATENT DOCUMENTS

| | | | | | |
|---|---|---|---|---|---|
| 2,667,658 | A * | 2/1954 | Cornick | A47B 83/00 | 15/265 |
| 3,072,949 | A * | 1/1963 | Smith | A47L 23/16 | 15/265 |
| 3,498,214 | A * | 3/1970 | Bailey | B42D 17/005 | 100/34 |
| 5,330,263 | A | 7/1994 | Wilkinson | | |
| 5,509,170 | A * | 4/1996 | LoFaro | A47L 23/16 | 15/257.01 |
| 6,145,931 | A * | 11/2000 | Subotic | A47C 7/506 | 297/188.11 |
| 7,644,810 | B2 | 1/2010 | Duncan | | |
| 8,240,769 | B1 * | 8/2012 | Story | A47C 16/00 | 297/423.1 |
| 8,905,484 | B2 | 12/2014 | Kim | | |
| 9,226,586 | B1 * | 1/2016 | Reid | A47C 7/748 | |
| 9,403,419 | B2 | 8/2016 | Litwing et al. | | |
| 9,723,930 | B2 * | 8/2017 | Burch | A47C 16/02 | |
| 10,251,488 | B2 * | 4/2019 | Lan | A47C 9/002 | |
| 2005/0285489 | A1 | 12/2005 | Brother | | |
| 2006/0054620 | A1 * | 3/2006 | Liu | B65D 11/1853 | 220/6 |
| 2009/0184612 | A1 | 7/2009 | McClure | | |
| 2012/0203150 | A1 * | 8/2012 | Eberhardt | A61H 1/005 | 601/55 |
| 2017/0360205 | A1 * | 12/2017 | Gordon | A47C 16/025 | |
| 2019/0144164 | A1 * | 5/2019 | Breyburg | A45C 5/02 | 220/495.01 |

* cited by examiner

SHOE CONTAINER STOOL WITH DEPLOYABLE FOOTREST

BACKGROUND OF THE INVENTION

Donning and doffing one's shoes can be a surprisingly difficult task given the need to bend over or find a seat to reach your feet and then having to fumble with the tongue, heel, and laces of the shoes to get them on your feet. Not only can this task be difficult, finding or locating your misplaced shoes can be half the battle. As various devices exist to help a person don and doff their shoes, several improvements can be made to provide an all-encompassing solution.

Thus there exists a need for a shoe container stool having a deployable footrest to help a person don and doff their shoes and also provide a reliable location for one to store their shoes.

FIELD OF THE INVENTION

The present invention generally relates to a stool, and more particularly, to a shoe container stool with a deployable footrest to house a pair of shoes therein and help a user don and doff their shoes.

SUMMARY OF THE INVENTION

The general purpose of the shoe container stool with a deployable footrest, described subsequently in greater detail, is to provide a shoe container stool which has many novel features that result in a shoe container stool which is not anticipated, rendered obvious, suggested, or even implied by prior art, either alone or in combination thereof. A shoe container stool with a deployable footrest is described herein. The shoe container may be in the general form of a hollow box having a front wall, a back wall, two side walls, and a top lid. In the front wall is a vertical elongated opening positioned through a middle portion of the front wall. The opening has at least two side edges and a bottom edge. Pivotally assembled to the opening is an elongated board. The elongated board includes an axle positioned transversely therethrough and at a location along the length of the board that separates the board into a top portion above the axle and a bottom portion below the axle. The axle has two opposing ends situated into respective axle caps located in the two side edges of the opening to permit the elongated board to pivot into and out of the elongated opening about the longitudinal axis of the axle. Thus, a user can deploy the elongated board from the opening to use the top portion of the board as a footrest to help don and doff their shoes.

The shoe container further includes a horizontal shelf positioned inside the hollow box at a vertical location between the axle and the top lid. The shelf has a bottom surface, and an abutment edge facing the elongated opening. The bottom surface contacts the bottom portion of the board to counter the forces applied to the top portion of the board when used as a footrest. The abutment edge abuts against the top portion of the board to stop the board from pivoting into the interior of the box.

The top lid of the shoe container can be opened to store one's shoes on the shelf inside the box and closed to permit the box to be used as a stool.

Thus has been broadly outlined the more important features of the present shoe container stool so that the detailed description thereof that follows may be better understood and in order that the present contribution to the art may be better appreciated. Objects of the present shoe container stool, along with various novel features that characterize the invention are particularly pointed out in the claims forming a part of this disclosure. For better understanding of the shoe container stool with a deployable footrest, its operating advantages and specific objects attained by its uses, refer to the accompanying drawings and description.

BRIEF DESCRIPTION OF THE DRAWINGS

In the figures, identical structures, element or parts that appear in more than one figure are generally labeled with a same numeral in all the figures in which they appear. Dimensions of components and features shown in the figure are generally chosen for convenience and clarity of presentation and are not necessarily shown to scale. The figures are listed below.

FIGURES

Figure 1:
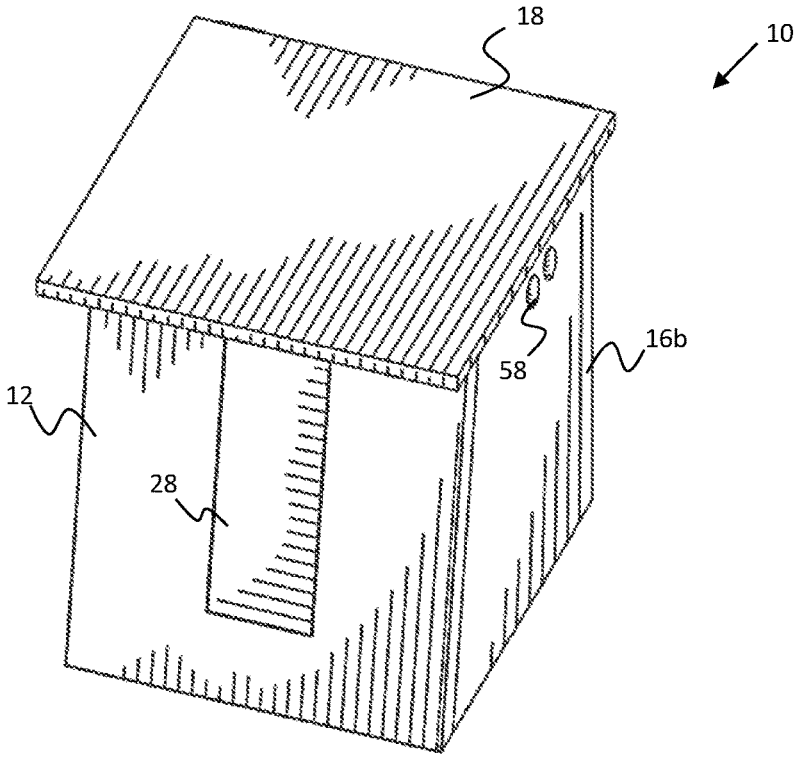

FIG. 1 depicts a perspective view of the shoe container stool with the footrest in a non-deployed state.

Figure 2:
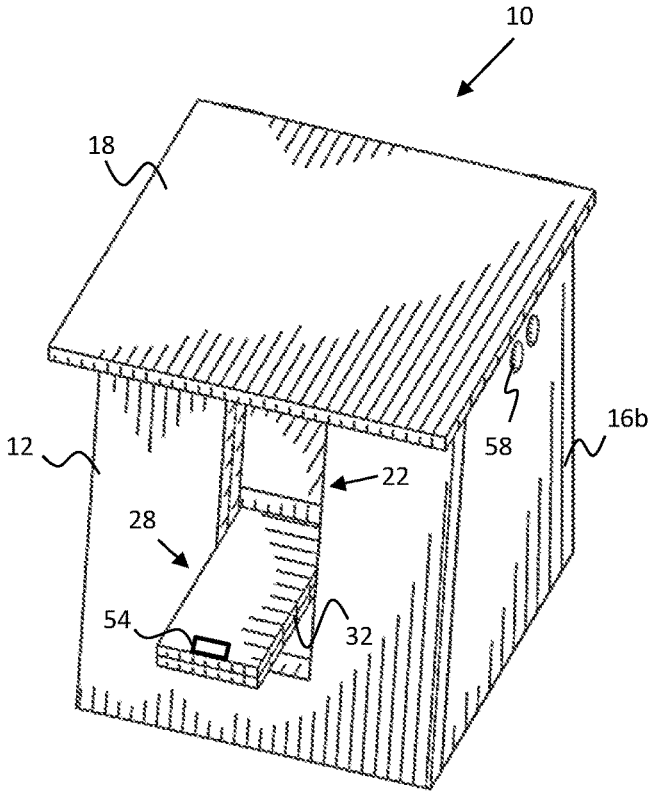

FIG. 2 depicts a perspective view of the shoe container stool with the footrest in a deployed state.

Figure 3:
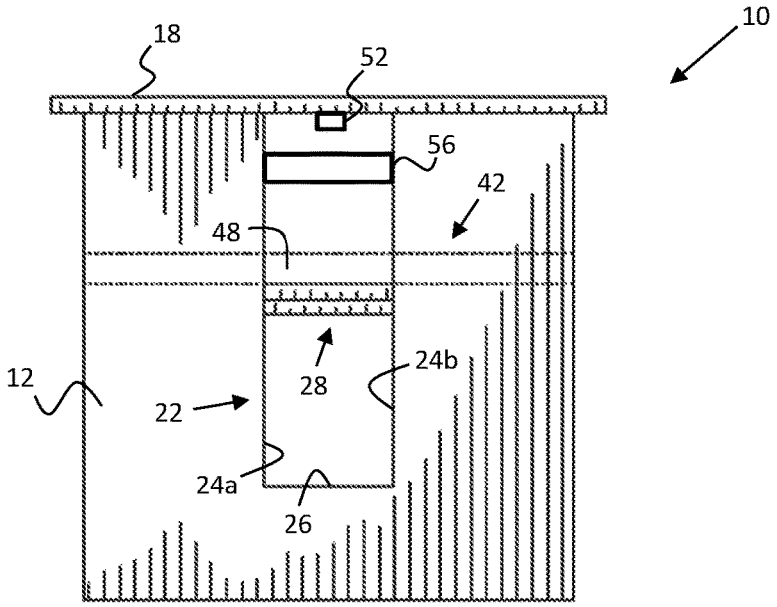

FIG. 3 is a front view of the shoe container stool with the footrest in a deployed state.

Figure 4:
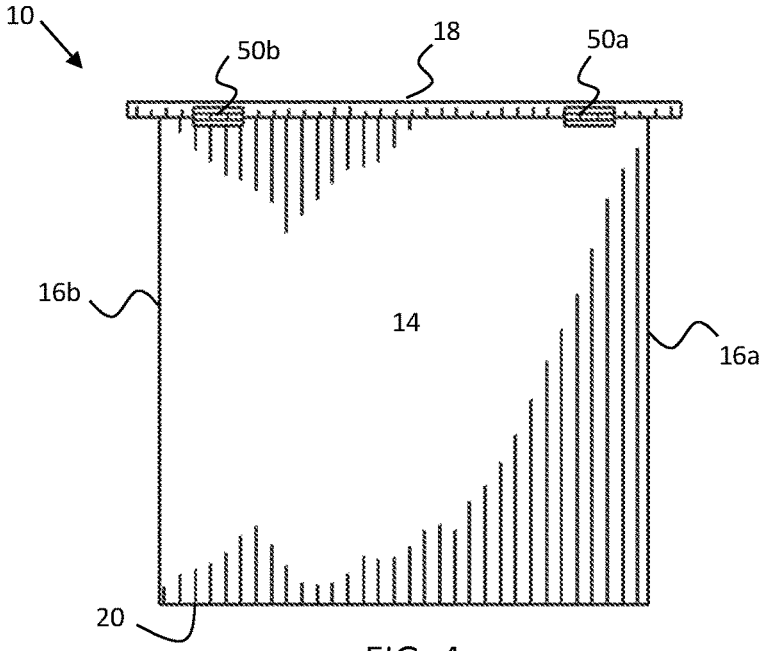

FIG. 4 is a back view of the shoe container stool.

Figure 5:
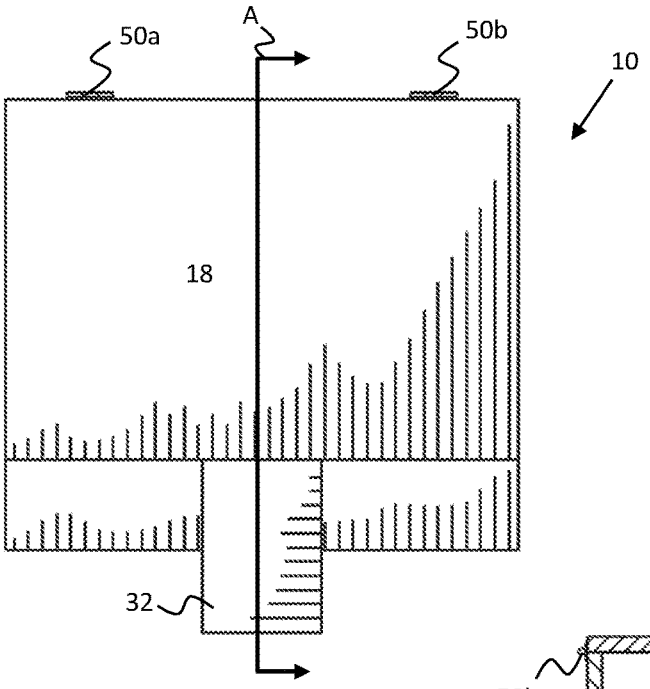

FIG. 5 is a top view of the shoe container stool.

Figure 6:
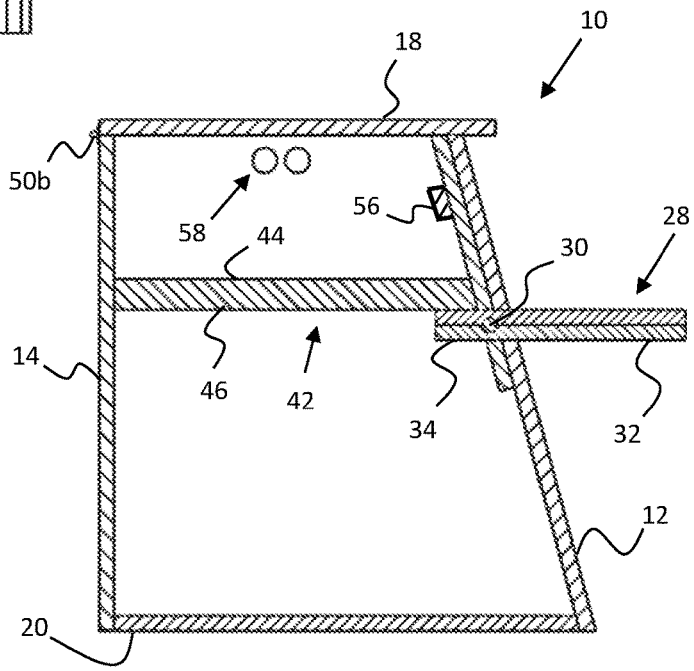

FIG. 6 is a cross-sectional side view of the shoe container stool along line A shown in FIG. 5.

Figure 7:
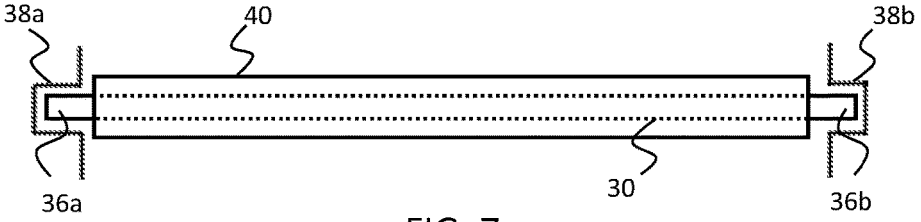

FIG. 7 is a detailed view of an axle pivotally connected the footrest to the shoe container stool.

DETAILED DESCRIPTION OF THE DRAWINGS

The present invention has utility as a shoe container stool with a deployable footrest to help a user a don and doff theirs while also providing a reliable location to store one's shoes. The following description of various embodiments of the invention is not intended to limit the invention to those specific embodiments, but rather to enable any person skilled in the art to make and use this invention through exemplary aspects thereof.

It is to be understood that in instances where a range of values are provided that the range is intended to encompass not only the end point values of the range but also intermediate values of the range as explicitly being included within the range and varying by the last significant figure of that range. By way of example, a recited range of 1 to 4 is intended to include 1-2, 1-3, 2-4, 3-4, and 1-4.

As used herein, the term 'shoes' refers to all types of footwear including, for example, sneakers, boots, sandals, formal footwear, high heels, and the like.

With reference now to the drawings, and in particular FIGS. 1 through 7 thereof, examples of the instant shoe container stool with deployable footrest employing the principles and concepts of the present shoe container stool with deployable footrest and generally designated by the reference number 10 will be described.

Referring to FIGS. 1 through 7 a preferred embodiment of the present shoe containter stool with deployable footrest 10 is illustrated. The shoe container stool 10 is generally in the form of a hollow box having a front wall 12, a back wall 14, two side walls (16*a*, 16*b*), and a top lid 18. In some embodiments, the bottom edges of the front wall 12, back wall 14, and two side walls (16*a*, 16*b*) contact the ground surface, while in other embodiments the hollow box further includes a bottom wall 20 that contacts the ground surface. As used herein, for position and orientation convention, 'vertical' refers to a direction from bottom to top or vice-versa, 'horizontal' refers to left to right from one side wall to the opposing side wall, 'length' refers to a direction/measurement along a longitudinal axis or the longest axis, 'width' refers to a direction/measurement in the transverse axis or a shorter axis than the longitudinal axis, and 'thickness' refers to a direction/measurement along the shortest axis perpendicular to the length and width. In the front wall 12 is a vertical elongated opening 22 positioned through a middle portion of the front wall 12. The vertical elongated opening 22 may be positioned along a central vertical axis of the front wall 12. The vertical elongated opening 22 is bounded by at least two side edges (24*a*, 24*b*) and a bottom edge 26, where the two side edges (24*a*, 24*b*) and bottom edge 26 have a width equal to the thickness of the front wall 12. The bottom edge 26 of the opening 22 is located at a vertical position between a center horizontal axis of the front wall 12 and a bottom edge of the front wall 12. In some embodiments, the vertical elongated opening 22 extends beyond a top edge of the front wall 12, where the top of the vertical elongated opening 22 is open to the surroundings. In other embodiments, the vertical elongated opening 22 includes a top edge positioned below the top edge of the front wall 12.

The shoe container 10 further includes an elongated board 28 that can pivotally rotate into and out of the elongated opening 22, where FIG. 1 shows the board 28 pivoted into the opening 22 and FIG. 2 shows the board 28 pivoted out of the opening 22. The elongated board 28 may have dimensions approximate to the dimensions of the elongated opening 22 to fit flush within the opening 22 when pivoted therein. The elongated board 28 is connected to the shoe container 10 by an axle 30 as shown in FIGS. 6 and 7. The axle 30 is positioned transversely through the board 28 at a location along the length of the board 28 that separates the board 28 into a top portion 32 above the axle 30 and a bottom portion 34 below the axle 30. In some embodiments, the axle is located at a position along the length of the board 28 such that the top portion 32 of the board 28 is longer than the bottom portion 34 of the board 28 to allow a user to kick the bottom portion 34 of the board 28 into the interior of the box to quickly deploy the longer top portion 32 out of the box to be used as a footrest.

The axle 30 connects the board 28 to the shoe container 10. The axle 30 includes two opposing ends (36*a*, 36*b*) extending beyond opposing sides of the board 28. In the two side edges (24*a*, 24*b*) of the opening 22 are holes having axle caps (38*a*, 38*b*) therein, where the opposing ends (36*a*, 36*b*) of the axle 30 are situated into the respective axle caps (38*a*, 38*b*) to permit the elongated board 28 to pivot into and out of the elongated opening 22 about the longitudinal axis of the axle 30. This mechanism permits a user to deploy the elongated board 28 from the opening 22 to use the top portion 32 of the board 28 as a footrest to help don and doff their shoes. In some embodiments, the axle 30 is positioned inside a sleeve 40 in the elongated board 28. The axle 30 and sleeve 40 rotate relative to one another to improve the rotation of the elongated board 28 into and out of the elongated opening 22.

The shoe container 10 further includes a horizontal shelf 42 positioned inside the hollow box as best seen in FIGS. 3 and 6. The horizontal shelf 42 is positioned in a vertical position between the axle 30 and the top lid 18. The shelf 42 includes a top surface 44, a bottom surface 46, and an abutment edge 48 facing the elongated opening 22. The bottom surface 46 of the shelf 42 contacts the bottom portion 34 of the board 28 to counter the forces applied to the top portion 32 of the board 28 when used as a footrest as best seen in FIG. 6. The abutment edge 48 abuts against the top portion 32 of the board 28 to stop the board 28 from pivoting into the interior of the box. The shelf 42 may have a length and width corresponding to the interior length and interior width of the box. In other embodiments, the shelf 42 may have a length and/or width that is shorter than the interior length and/or interior width of the shoe container 10 as long as the shelf 42 can contact the bottom portion 34 of the board 28 to counter the aforementioned forces.

The top lid 18 of the shoe container 10 can be opened to store one's shoes on the top surface 44 of the shelf 42. The top lid 18 can then be closed, where a user can sit on the top lid 18 to use the shoe container 10 as a stool. The top lid 18 may be connected to the back wall 14 with one or more hinges (50*a*, 50*b*) to permit a user to pivotally open the top lid 18 without having to remove the entirety of the top lid 18 from the shoe container 10.

The shoe container 10 may further be optimally configured to accommodate users of all sizes. One such configuration is to angle the front wall 12 and elongated opening 22 to provide additional room for the user's foot on the top portion 32 of the deployed board 28. In a particular embodiment, the front wall 12 and opening 22 are angled between 10 degrees and 20 degrees from the vertical and towards the interior of the box to provide this additional room as best seen in FIG. 6. In a specific embodiment, the front wall 12 and elongated opening 22 are angled at 15 degrees from the vertical and towards the interior of the box.

The shoe container 10 may further include one or more mechanisms to help secure the elongated board 28 in the opening 22 when pivoted therein. In a particular embodiment, the shoe container 10 includes a first securing mechanism 52 attached to either one of the top lid 18 or the front wall 12, and a second securing mechanism 54 attached to the elongated board 28. The first securing mechanism 52 and second securing mechanism 54 are configured to couple together to hold the elongated board 28 in the opening 22 when pivoted therein. In an embodiment, the first securing mechanism and the second securing mechanism magnetically couple to hold the elongated board in the opening when pivoted therein. In a more specific embodiment, the first securing mechanism is a magnet extending down from the top lid 18 and into the elongated opening 22, and the second securing mechanism is a ferromagnetic or paramagnetic material located on a surface of the top portion 32 of the elongated board 28 as best seen in FIGS. 2 and 3. It should be appreciated that the magnet may be located on the surface of the top portion of the elongated board, and the ferromagnetic or paramagnetic material extends down from the top lid 18 and into the opening 22. It should further be appreciated that other securing mechanism may be used such as a latch, but may not be as efficient as a magnetic coupling.

The shoe container 10 may further include a cross-board 56 positioned lengthwise on an interior surface of the front wall 12 and extending the width of the elongated opening 22. The cross-board 56 is located at a vertical position above the shelf 42 and below the top lid 18, where the cross-board 56 further stops the top portion 32 of the elongated board 28 from pivoting into the interior of the box.

The shoe container 10 may further include one or more venting holes 28 positioned through at least one of the front wall 12, back wall 14, two side walls (16*a*, 16*b*), or top lid 18. In specific embodiments, the shoe container 10 includes two pairs of venting holes 58, each pair positioned through opposing walls of the two side walls (16*a*, 16*b*), respectively. Each pair of venting holes 58 may further be located near a top edge of their respective side wall (16*a*, 16*b*). The venting holes 88 primarily allow shoes stored in the shoe container 10 to dry from sweat or from getting wet. The venting holes 58 may also be used to help a user maneuver the shoe container 10 to one position or another.

OTHER EMBODIMENTS

While at least one exemplary embodiment has been presented in the foregoing detail description, it should be appreciated that a vast number of variations exist. It should also be appreciated that the exemplary embodiment or exemplary embodiments are only examples, and are not intended to limit the scope, applicability, or configuration of the described embodiments in any way. It should be understood that various changes may be made in the function and arrangement of elements without departing from the scope as set forth in the appended claims and the legal equivalents thereof.

What is claimed is:

1. A shoe container stool with deployable footrest comprising:

a hollow box having a front wall, a back wall, two side walls, and a top lid;

a vertical elongated opening positioned through a middle portion of the front wall, said opening having two side edges and a bottom edge;

an elongated board having an axle positioned transversely therethrough and at a location along the length of the board that separates the board into a top portion above the axle and a bottom portion below the axle, said axle having two opposing ends situated into respective axle caps located in the two side edges of the opening to permit the elongated board to pivot into and out of the elongated opening about the longitudinal axis of the axle, whereby a user can deploy the elongated board from the opening to use the top portion of the board as a footrest to help don and doff their shoes; and a horizontal shelf positioned inside the hollow box at a vertical location between the axle and the top lid, said shelf having a bottom surface, and an abutment edge facing the elongated opening, wherein the bottom surface contacts the bottom portion of the board to counter the forces applied to the top portion of the board when used as a footrest, and wherein the abutment edge abuts against the top portion of the board to stop the board from pivoting into the interior of the box; and wherein said top lid can be opened to store one's shoes on the shelf inside the box and closed to permit the box to be used as a stool.

2. The shoe container stool of claim 1 wherein the front wall and elongated opening formed therein are angled between 10 degrees and 20 degrees from the vertical towards the interior of the box to provide additional room for a user to don and doff their shoes on the footrest.

3. The shoe container of claim 2 further comprising a first securing mechanism attached to either one of the top lid or the front wall, and a second securing mechanism attached to the elongated board, wherein the first securing mechanism and second securing mechanism couple together to hold the elongated board in the opening when pivoted therein.

4. The shoe container of claim 3 wherein the first securing mechanism and the second securing mechanism magnetically couple to hold the elongated board in the opening when pivoted therein.

5. The shoe container of claim 4 wherein the first securing mechanism is a magnet extending down from the top lid and into the opening, and the second securing mechanism is a ferromagnetic or paramagnetic material located on a top surface of the top portion of the elongated board.

6. The shoe container of claim 3 wherein the axle is positioned inside a sleeve in the elongated board, wherein the sleeve rotates relative to the axle to improve the rotation of the elongated board into and out of the elongated opening.

7. The shoe container of claim 6 further comprising a cross-board positioned lengthwise on an interior surface of the front wall and extending the width of the elongated opening, said cross-board positioned at a vertical position above the shelf and below the top lid, where the cross-board further stops the top portion of the elongated board from pivoting into the interior of the box.

8. The shoe container of claim 7 wherein the vertical elongated opening extends beyond a top edge of the front wall, and the bottom edge of the opening is positioned between a center horizontal axis of the front wall and a bottom edge of the front wall.

9. The shoe container of claim 8 wherein the axle is located along the length of the elongated board such that the top portion of the board is longer than the bottom portion of the board to allow a user to kick the bottom portion of the board into the interior of the box to quickly deploy the longer top portion out of the box to be used as a footrest.

10. The shoe container of claim 9 further comprising one or more hinges connecting the top lid to the back wall to permit a user to pivotally open the top lid without having to remove the entirety of the top lid from the shoe container.

11. The shoe container of claim 10 further comprising two pairs of venting holes, each pair positioned through opposing walls of the two side walls to allow shoes therein to dry from sweat or from getting wet.

12. The shoe container of claim 11 wherein the two pairs of venting holes are each located near a top edge of their respective side walls.

13. The shoe container of claim 12 wherein the shelf has a length and width corresponding to the interior length and interior width between the back wall, front wall, and two side walls.

14. The shoe container of claim 13 wherein the hollow box further comprises a bottom wall.

* * * * *